United States Patent [19]

Ford

[11] Patent Number: 5,005,450

[45] Date of Patent: Apr. 9, 1991

[54] SELF-LOCKING TOOL

[76] Inventor: Vernon Ford, 28 Hemenway Rd., Cheektowaga, N.Y. 14225

[21] Appl. No.: 496,955

[22] Filed: Mar. 21, 1990

[51] Int. Cl.[5] ..... B25B 7/14

[52] U.S. Cl. ..... 81/318; 81/324; 81/329; 81/381

[58] Field of Search ..... 81/308, 318, 324, 329, 81/339, 342, 381

[56] References Cited

U.S. PATENT DOCUMENTS

| | | | |
|---|---|---|---|
| 2,370,308 | 2/1945 | Hanson | 81/381 X |
| 2,787,925 | 4/1957 | Buchanan et al. | 81/308 X |
| 3,126,775 | 3/1964 | Ramge | 81/318 |
| 3,257,878 | 6/1966 | Andersen | 81/318 |

*Primary Examiner*—James G. Smith

*Attorney, Agent, or Firm*—James J. Ralabate

[57] ABSTRACT

The locking tool of this invention comprises three or more pieces. All three pieces are connected together with an axle pin. A first handle piece has one or more arc-like slots which criss-cross with one or more slots in a second handle piece. A third piece called a jaw piece has a vertical slot that is coextensive with the other two slots. A locking pin is movably positioned in and through the three slots. When pressure is exerted upon the two handle pieces, this locking pin is tilted against the walls of the slots to lock the jaws of the tool in position. When pressure is exerted on the handles, the slots can leverage the pin both rotationally and radially. Resistance to the pin movement either radial or rotational causes the pin to be tilted against the walls of the slot in such positions as to preclude natural reversed movement of the pin as in a one-way valve.

17 Claims, 3 Drawing Sheets

Fig. 5e
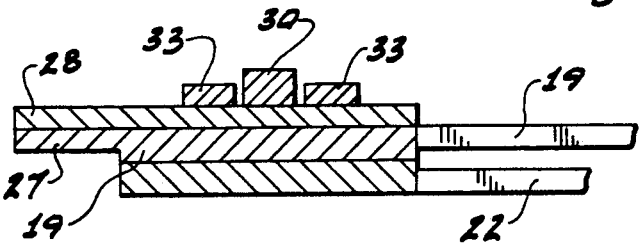
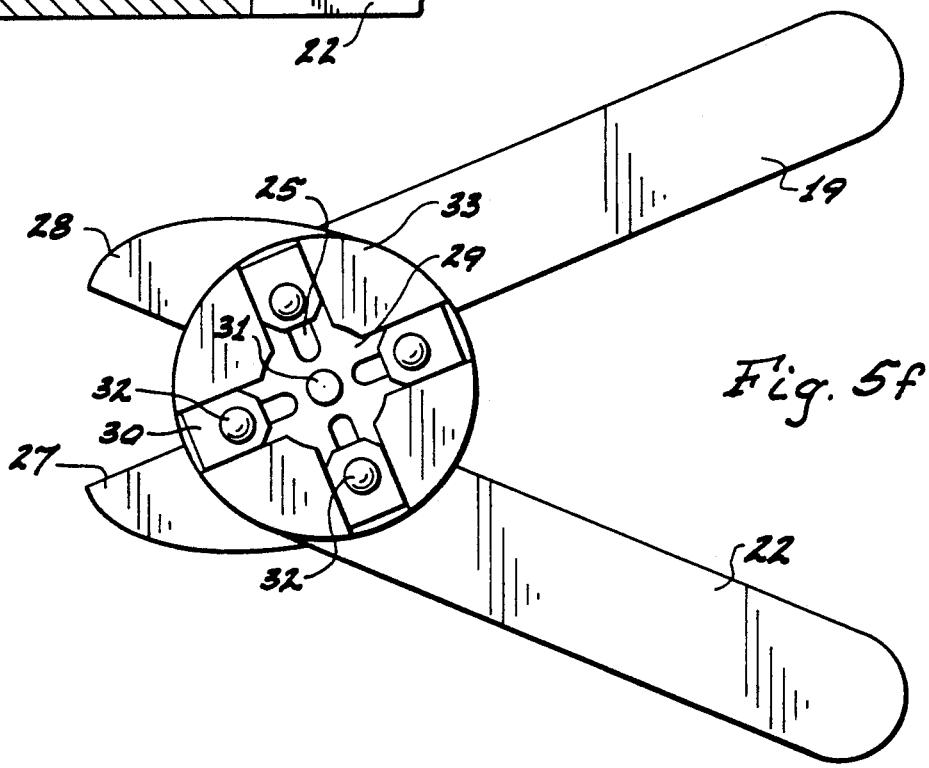
Fig. 5f
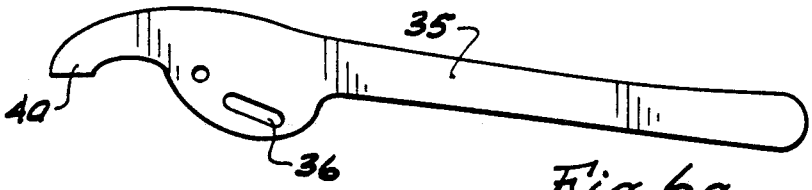
Fig. 6a
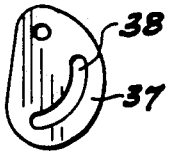
Fig. 6b
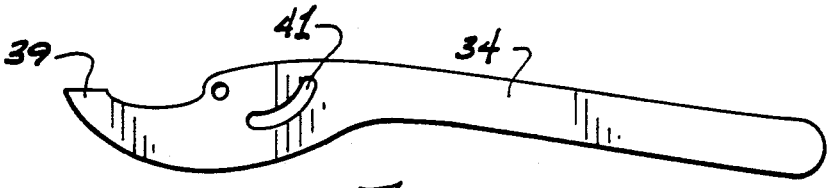
Fig. 6c

SELF-LOCKING TOOL

This invention relates to a locking tool and, more particularly, to a tool that will lock an object in place upon the application of pressure.

BACKGROUND OF THE INVENTION

It is known to use various tools for holding and locking work objects in place. There are other tools which utilize connecting parts that are rotatable upon a common axis. Some of these tools are disclosed in U.S. Pat. Nos. 682,701; 644,825; 1,026,270; 1,401,931; 1,450,875; 1,717,726; 2,574,909 and 4,633,558.

In U.S. Pat. No. 682,701 (Howland) a locking pliers is disclosed having a plurality of pieces movable along a multitude of pivot points. There is a central pivot A having 5 or 6 separate pieces movable thereabout. When the pliers of Howland is in the locked position an object is held between jaws B and C which are in turn pivotally connected to D, H, J and r. Howland's device is relatively complex in usage and construction. Both handles of Howland's also must be held at all times during use in order to maintain an object locked in position. Also, Howland requires a high friction surface to function properly.

U.S. Pat. No. 644,825 (Jensen) discloses a wrench having handle means that can be locked in place by a spring means n. The spring is positioned on the bottom portion of one of the handles. When pin g of Jensen is pressed out of the socket h, it is slid into the socket g and spring n holds it in place. The holding device of Jensen is again relatively complex in construction and would be relatively expensive to manufacture.

U.S. Pat. No. 1,026,270 (Leonard) discloses a pipe wrench with a holding device to permit the wrench to be applied to a pipe or rod. A spring 15 in Leonard engages the handle 13 and its opposite end is secured to the shank of the wrench. The spring 15 locks the handle in position between the jaws 5 and 6. As in many locking tools, Leonard relies upon a spring means to provide the locking mechanism in his device.

In Whelan U.S. Pat. No. 1,401,931 an adjustable pipe wrench is disclosed which uses a quadrant attachment element together with two jaws to hold an object in position. The wrench of Whelan holds pipes or the like of various diameters with a three point grip, each of the three elements having a gripping surface.

McGill 1,717,726 and Burrows 2,574,909 each disclose wrenches having holding means to tightly hold items. Each discloses a wrench having several parts and several focal points for each part. Included in both patents are adjusting means to tighten or loosen objects held within the jaw assemblies of the respective wrenches.

In Teselsky 1,450,875 a pliers is disclosed having a third jaw section that will coact with the other two jaws of the pliers to prevent the article gripped from slipping. Handle means 5 and 6 of Teselsky each terminate with a jaw section, these jaw sections have a shank mounted around the exterior portion of one of the jaws. This shank acts as a third jaw which coacts in a gripping operation.

Spaulding, U.S. Pat. No. 4,633,558, discloses a tool for applying a spring clamp to an object. Spaulding utilizes a cam which is carried by one of the jaws and a pair of side plates pivotally supported by the other of said jaws having cam control tracks therein for affecting and controlling radial movement of said cam to complete closure of said clamp. There are means on a jaw for controlling rotation of the cam and the cam is engaged to a hook portion to the spring clamp to effect closure.

All of the above prior art devices are relatively complex in structure, most require springs for a locking effect and several are complicated to use. There is a need for a relatively simply-constructed tool that will lock an object in position without the need for springs or other such means.

SUMMARY OF THE INVENTION

It is therefore an object of this invention to provide a locking tool devoid of the above-noted disadvantages.

Another object of this invention is to provide a locking tool that is relatively easy to use yet effective in holding an object securely.

Yet another object of this invention is to provide a locking tool that is relatively simple in construction and relatively inexpensive to use.

Another still further object of this invention is to provide a tool having a cam leverage advantage either as a primary pressure applying force or as a secondary function to tilt and thereby lock the tool.

Still another object of this invention is to provide a locking tool having two handle means wherein only one needs to be held after pressure has effected a locking of the object.

A still further object of this invention is to provide a locking tool that can be used to easily lock and release an object held therein.

Still yet a further object of this invention is to provide a tool that has means to lock in four directions; rotationally counter-clockwise, clockwise and radially in and out.

Yet still a further object of this invention is to provide a locking tool wherein once the lock is effected, handle pressure can be released without affecting the lock.

These and other objects are accomplished by the present invention by providing a novel locking tool comprising in combination two handle pieces and a jaw piece. The first of the handle pieces has an axle aperture through which it is connected to the other two pieces via their axle apertures. A pin or other suitable means is extended through the three apertures and closed at both ends to movably fix the pin in position. All three pieces will rotate around the pin which acts as the focal point for the locking tool. The axle apertures and axle pin can be located on a plane above or below the arc-like slots described hereinafter. The first handle piece has a jaw at its upper end opposite the hand grip section of the piece. Below the jaw in the first handle piece is the axle aperture and below (or above) the axle aperture is an arc-like slot. The second handle piece has no jaw at its upper end but contains an axle aperture and below (or above) this aperture is positioned an arc-like slot. The third or jaw piece has no handle but contains a jaw section which is complementary to the jaw in the first handle piece and forms a gripping means therewith. The term "jaw" throughout this disclosure and claims will include any gripping surface. The arc-like slots can be in the handle portions or in another embodiment, one can be in the third piece. Conversely, the vertical slot can be in one of the handle pieces. In a preferred embodiment, below the jaw section of this third piece is the axle aperture and below (or above) the axle aperture is an upright or vertically disposed slot. By "vertically disposed" is meant throughout this disclosure and claims an upright slot that varies from exactly vertical to about 25° from vertical when measured from the direct center of the axle aperture. A locking pin extends through the slots of all three pieces and is movable through the entire slots when in use. A plurality of slots can be used thereby allowing any slot to axle positioning (top, bottom or side).

The arc-like slots in the first and second handle pieces spiral in opposite directions (as shown in FIG. 3 described below) which is critical to the present invention. When the first and second handle pieces are stacked adjacent each other (or alternatively stacked together with the third or jaw piece) the spiralling slots overlap each other to form a diamond-shaped opening. The locking pin extends through this diamond-shaped opening. When the handle pieces spin around each other, the slot walls push the pin by touching the pin with two adjacent sides of one of the four diamond corners. The application of a squeezing pressure on the two handles with a resisting force affecting the pins will move or force the locking pin to tilt since the pin is not supported at the other end of the stacked pieces. When the locking pin tilts, it locks the jaws together thereby holding an object securely between the jaws. At all times the locking pin is movably extended through the three slots in the first and second handle pieces and the third jaw piece. To release an object locked between the jaw sections the user actively forces the handle pieces apart causing the pin to straighten thereby releasing the lock and the object will fall loose. As the arc-like slots in the first and second handle pieces cross each other during use, they form an X-like configuration with each other and thereby form a diamond-like opening at their point of overlap or point of crossing. During use, the locking pin travels in an arc-like motion in the handle slots while it travels in an up-down motion in the jaw piece slot. When the handle parts are pressed together, the locking pin travels up the jaw piece slot toward the axle pin. The locking pin will lock in both a radial and in a rotational direction. All of the slots in the three pieces should have a width dimension slightly more than the diameter of the locking pin to permit it to be freely movable therein. In a preferred embodiment of the invention one slot is used in each of the three pieces, however, more than one slot in each can function equally well. It is important, however, that the arc-like slots whether one or several in the first and second handle pieces be positioned so that they spiral in the opposite direction to the corresponding slot in the adjacent handle piece. These slots can be concave (as shown in FIGS. 1–5) or convex, if desired. Each of these corresponding slots must form an X-like pattern when they cross and form a diamond-like opening which is common to both slots. The slots in the jaw piece will be substantially vertically disposed and in alignment with each of the plurality of slots in the handle pieces. The locking pin, when the locking tool is in the unlocked mode, will be substantially horizontal, but when in a locked mode will be tilted off horizontal against at least one side of each slot or diamond wall, pointed at one corner of the diamond hole or aperture. This cause the locking effect of this invention.

While there can be one slot or a plurality of slots in each of the three pieces, there must be at least one slot in each piece and at least one axle pin and at least one locking pin. Also, if desirable, the substantially vertical slot(s) can be in a handle piece and the arc-like slots in the other handle piece and third piece.

Regardless whether the handle pieces are rotated against the pin or the pin is pushed externally against the pieces, when blocking occurs the pin tilts. Since there is nothing to hold the pin parallel to the axle, the pin begins to tilt in the direction of the force on the pin whether the external force on the pin or the blocking force against the pin moving, from the rotation of the handle pieces.

Tilt occurs when the pin slides down the closest top or bottom slot wall; the pin attempts to fall down into this closest slot. It continues to fall until the opposite end of the pin hits the opposite two adjacent sides of the diamond hole. The opposite end of the pin then attempts to raise into its nearest slot (toward the original force in a reversed direction). Once it touches these slot edges the pivot begins. The points actually contacted along all four diamond walls are such that they closely balance or neutralize each other. The pin force directed at one corner equals the opposite reaction force at the opposite end of the pin in the opposite direction at the opposite diamond corner.

While the locking pin remains parallel to the axle (even), the pin, if forced externally, would push toward one of the four corners on two adjacent sides of the diamond-shaped hole. This would begin to rotate the handle pieces in opposite directions t each other as the pin plows along the walls of the slot. Usually (and especially with a pin of a much smaller diameter than the slot width) the opposite corner of the diamond hole with its two adjacent sides are not affected at all. These two walls rotate along with the affected two walls usually not even touching the pin.

When the pin becomes tilted, the pin can still plow toward a corner against its two adjacent walls but now the pin tilt has the opposite end of the pin touching the opposite adjacent walls. If the pin is externally pushed further, it begins to rotate the handle pieces. The opposite corner and its two walls now have no room or clearance to slide rotationally around the pin. The walls are blocked by the diameter of the pin being in a tilted shape and contacting said pin around and behind the circumference of the pin. The pin is held in position by the blocking force in one direction and by the opposing walls (one on each of the two plates) in the other direction. Additional force would only tend to tilt the pin more making the opposite two adjacent walls more blocked to a release rotation.

The tool of this invention can be used in hand tools such as pliers or wrenches or in vices, other gripping devices, hinging devices with position locking and as a differential clutching or locking device to the relative speeds of rotation of the plates.

BRIEF DESCRIPTION OF THE DRAWING

FIG. 2 including

FIG. 5 including FIGS. 5A–5F illustrates a side plan view of an embodiment of this invention having a plurality of slots and locking pins. FIGS. 5A–5D are side plan views of the disassembled component parts in this embodiment, and FIG. 5F is a side plan view of the assembled tool made up of components of FIG. 5A–5D.

FIG. 6 including FIGS. 6A–6C is a side plan view of the disassembled component parts or pieces of another embodiment of the locking tool of this invention.

DETAILED DESCRIPTION OF THE DRAWINGS AND PREFERRED Embodiments

Figure 1:
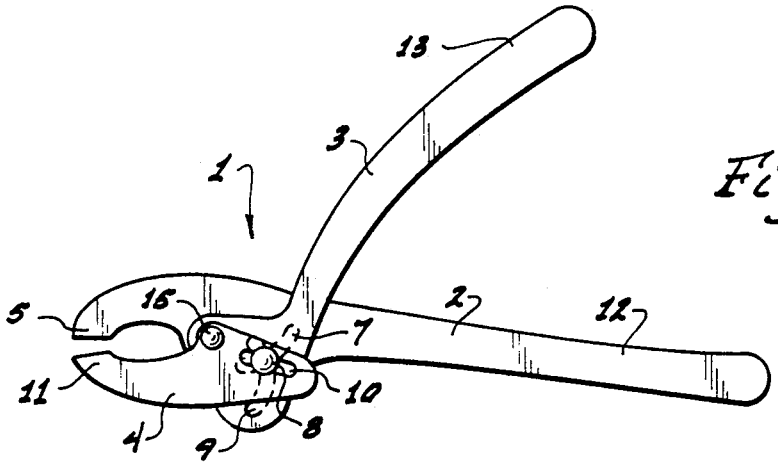
FIG. 1 is a plan side view of the assembled locking tool of this invention.
Figure 2A:
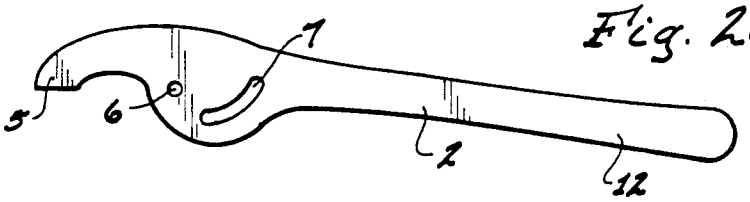
FIGS. 2A–2E illustrate a side plan view of the disassembled main component parts or pieces of the locking tool in a preferred embodiment of this invention.
Figure 2B:
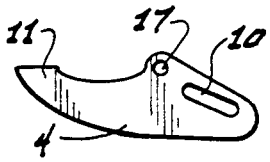
Figure 2D:
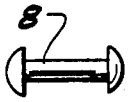
Figure 2C:
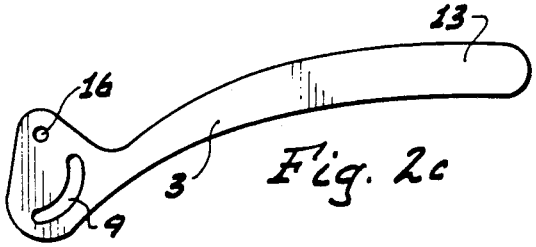
Figure 2E:
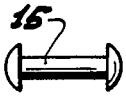

In FIG. 1 the locking tool 1 of this invention is illustrated in its assembled condition. The tool 1 comprises in this embodiment three main component pieces, a first handle piece 2, a second handle piece 3 and a jaw piece (third piece)4. The first handle piece 2 has in its upper portion a jaw section 5, and below the jaw section 5 and axle aperture 6 (see FIG. 2). Below the axle aperture 6 in first handle piece 2 is a first slot 7 through which a locking pin 8 will travel. Locking pin 8 will also travel in and extend through a second slot 9 in second handle piece 3 and a third vertically-disposed slot 10 in jaw piece 4. Locking pin 8 will move as handles in handle pieces 2 and 3 are moved together or pushed apart. When an object is placed between jaw sections 5 and 11 and handles 12 and 13 are squeezed together, locking pin 8 travels or moves in an arc-like fashion through slots 7 and 9 and moves up or down in vertical slot 10. As jaws 5-11 are closed upon and grip an object and closing pressure is exerted upon handles 12 and 13 locking pin 8 is tilted off its original horizontal position and pushes up against or wedges against the walls of the slots 7 and 9 to thereby lock the jaws 5 and 11 in position. When slots 7 and 9 cross or overlap each other in an X-like fashion (see FIG. 3) they form a diamond-like opening 14 (of FIG. 3). Locking pin 8 at some point along its length wedges against the walls of this diamond-like opening 14 when the pin 8 locks in position. An axle pin 15 provides the focal point around which all of the pieces 2, 3 and 4 rotate in use. Axle pin 15 is disposed substantially horizontally through all three pieces 2, 3 and 4 via the apertures 7, 9 and 10 respectively. When locking pin 8 is in its normal condition (unlocked) it will be substantially parallel to the horizontally-disposed axle pin 15. When locking pin 8 is forced against the walls of slots 7 and 9 in a locked position, it will tilt away from its parallel position to axle pin 8. Regardless whether pieces 2 and 3 are rotated via axle pin 15 against the locking pin 8 or the pin 8 is pushed externally against the pieces 2 and 3 when locking occurs the locking pin 8 will tilt. Since there is nothing to hold the pin 8 parallel to the axle pin 15, the pin 8 begins to tilt in the direction of the force on the pin 8 whether the external force on the pin 8 or the blocking force against the pin 8 moving, from the rotation of pieces 2 and 3. Tilt of pin 8 occurs when the pin 8 slides down the closest top or bottom slot 7 or 9 walls. It continues to fall until the opposite end of the pin B hits the opposite two adjacent sides of the diamond opening 14 (see FIG. 3). The opposite end of the pin 8 then to raise into its nearest slot (toward the original force in a reverse direction). Once pin 8 touches these slot 7 and 9 edges, the pivot or tilt of pin 8 begins. The pin 8 force directed at one corner of diamond opening 14 equals the opposite reaction force at the opposite end of the pin in the opposite direction at the opposite diamond 14 corner.

In FIG. 2 the three component pieces 2, 3 and 4 of locking tool 1 are illustrated. The first handle piece 2 has a jaw section 5 at its upper terminal end and a handle section 12 at its opposite terminal end. Below the jaw section 5 is an axle aperture 6 through which axle pin 15 extends when the tool 1 is assembled. Below axle aperture 6 is positioned an arc-like slot 7 through which locking pin 8 will extend when tool 1 is assembled. Slot 7 has a width just slightly (enough for pin 8 to be freely movable therein) greater than the diameter of pin 8. It is critical to the present invention that slot 7 be disposed on first handle piece 2 in a manner that when assembled and stacked with the other two pieces 3 and 4, it will form an X-like configuration and a diamond opening 14 with slot 9. Jaw section 5 will form the grip when it moves toward complementary jaw section 11. In second handle piece 3 the upper section of piece 3 has an axle aperture 16 which will house axle pin 15 when pin 15 extends through the axle apertures 6, 16 and 17 in pieces 2, 3 and 4 respectively. Below aperture 16 in piece 3 is an arc-like slot 9 which will criss-cross with slot 7 when in a stacked assembled relationship. Any stacking order of parts 2, 3 and 4 can be accomplished as long as the intended locking effect is accomplished. In the third piece or jaw piece 4 a jaw section 11 is provided which will form a biting or gripping section with jaw section 5 on first handle piece 2. Below jaw section 11 is provided an axle aperture 17 which will receive and house together with aligned apertures 6 and 16 pin 15. Below aperture 17 is a substantially vertically disposed (when assembled as in FIG. 1) slot 10 that will house together with slots 7 and 9 locking pin 8. When the term "substantially vertically disposed" or "vertically disposed" is used throughout this disclosure it is meant that the axis of slot 10 is from 0°–25° off from a vertical drop line drawn vertically from the center of aperture 17. The slot 10 in FIG. 2 is drawn at an angle of about 14° off from a pure vertical line from the center of aperture 17. Pins 8 and 15 are shown having bevelled edges at their terminal ends, however any type bolt, screw, rod or the like can be used as long as it is freely movable in slots 7, 9 and 10 (in locking pin) or can suitably act as an axle pin 8.

Figure 3:
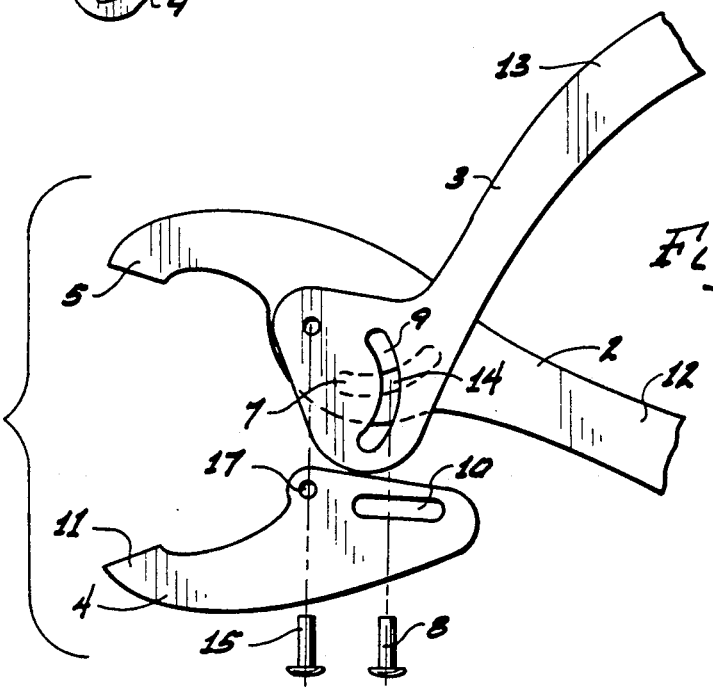
FIG. 3 is a top plan breakaway view of the interaction of the slots in the handle pieces of this invention showing the X-configuration and diamond shaped opening.

In FIG. 3 a top breakaway view of the pieces 2, 3 and 4 is illustrated. Shown in FIG. 3 is the X-like patter formed by slots 7 and 9 which criss-cross to form diamond opening 14. It is through this diamond opening 14 that locking pin 8 wedges when jaws 5–11 are tightened against an object to be held. When handle sections 12 and 13 are pushed together jaw sections 5 and 11 are pressed against an object to be held and the pressure exerted thereon will cause pin 8 to tilt against the walls 14 and lock the jaws 5 and 11 in place. To release the lock effect, handle sections 12 and 13 actively straighten the pin by being spread apart and locking pin 8 will be released from its locking mode against the walls of diamond opening 14.

Figure 4A:
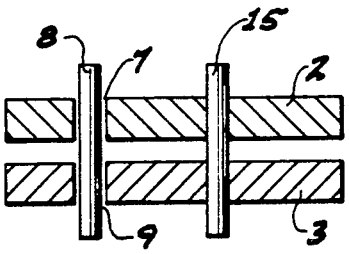
FIG. 4 is a side schematic view showing in 4A the position of the locking pin in a normal condition, and in 4B the position of the locking pin in a locked condition.
Figure 4B:
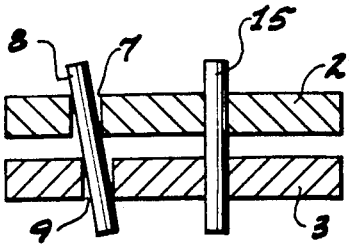

In FIG. 4 a side schematic view showing in 4A the locking pin 8 in an unlocked position which is parallel to axle pin 15. First, handle piece 2 is shown stacked against handle piece 3 wherein slots 7 and 9 are substantially perfectly aligned. Locking pin 8 is freely movable in slots 7 and 9 until a locking pressure is exerted upon handle sections 12 and 13 whereupon locking pin 8 becomes distorted from parallel and is tilted against the walls of slots 7 and 9 (or diamond opening 14) to hold both first and second handle pieces 2 and 3 in a locked position as shown in FIG. 4B. Axle pin 15 remains substantially in place throughout the locking and unlocking process but locking pin 8 is distorted from parallel when locked.

Figure 5A:
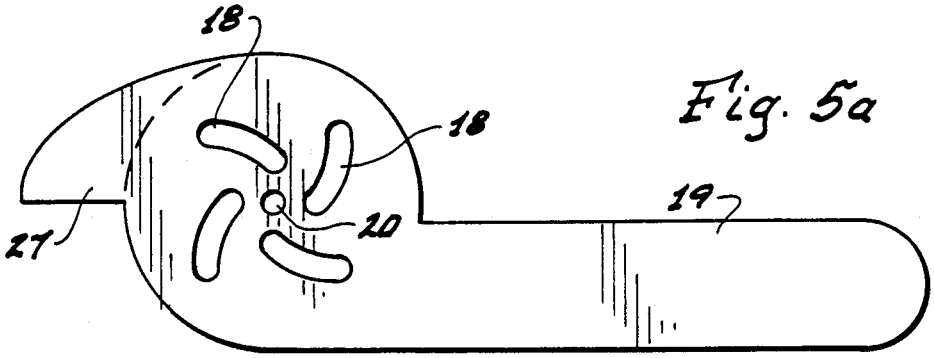
Figure 5B:
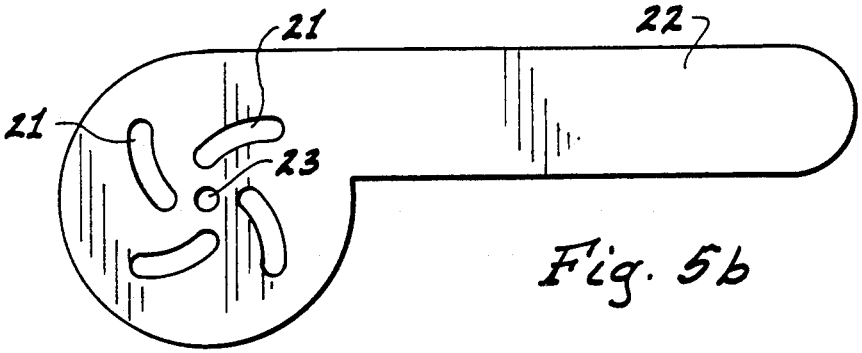
Figure 5C:
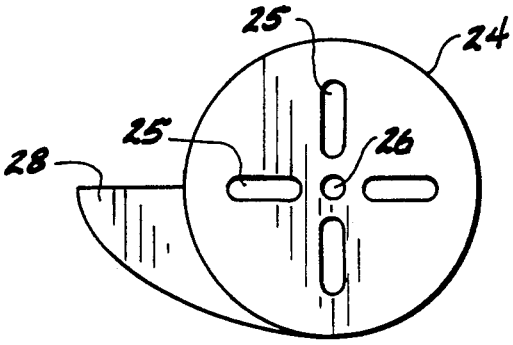
Figure 5D:
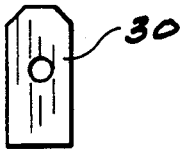

In FIGS. 5A - 5F another configuration of the locking tool is illustrated. Rather than using one slot in each handle piece as shown in the previous figures, a plurality of slots such as slots 18 can be used in first handle piece 19 of FIG. 5A. These slots 18 would be disposed around an axle aperture 20 and would allow four separate locking pins to travel in slots 18. As shown in FIG. 5B, complementary slots 21 would be positioned in second handle piece 22 and would be positioned so each slot 21 would criss-cross with its corresponding adjacent slot 18 to form a plurality of diamond shaped openings 14 (as shown in FIG. 3). These slots 21 would also be disposed around an axle aperture 23. The third piece 24 (as shown in FIG. 5C) would house vertical slots 25 which would function in a similar manner to vertical slot 10 shown in the earlier figures. Also located in piece 24 is a centrally-disposed axle aperture 26 which is aligned with apertures 20 and 23 when the tool is assembled. An axle pin then would be extended through each aperture 20, 23 and 26.

In this embodiment, jaws 27 and 28 may be used together with a central gripping area 29 or 29 can be used without jaws 27 and 28. In the embodiment where central gripping area 29 is used, movable wedges 30 of FIG. 5D travel toward and away from axle pin 31 as shown in FIG. 5F. These wedges 30 are connected to locking pins 32 and would move inwardly (toward axle pin 31) when in a locking motion or outwardly (away from axle pin 31) when in a releasing or unlocking motion. Wedges 30 move in interstices formed by wedge blocks or guides 33. An item or object to be locked would then be held in gripping area 29 by the wedges 30 which are locked in position. In FIG. 5F, the components 19, 22 and 24 of FIGS. 5A, 5B and 5C are connected together by an axle pin 31 with four separate locking pins 32 positioned in slots 18, 21 and 25, also shown in FIGS. 5A–5C. An object to be locked in place can be put between jaws 27 and 28 or can be put in central gripping area 29. When put in central gripping area 29 the tool would function as in a socket system. The wedges 30 use the radial aspect of the locking tilt (earlier discussed in relation to FIG. 4) to form a socket-like function whereby the four wedges 30 crush into an object placed in gripping area 29. In this mode the locking pins 32 all tilt primarily outward. While in FIGS. 5A and 5B four of each slots 18, 21 and 25 are shown and four wedges 30 are shown, any amount of slots or wedges may be used if desirable. The term "wedges" used throughout the claims and disclosure includes structures where the pins act as the wedge.

In FIG. 5E, a side view of the tool showing jaws or gripping means 27 and 28 are shown in relation to wedge block guides 33 and wedge 30. First handle piece 19 and second handle piece 22 are shown extending outwardly from the gripping area and wedges 30.

As noted, while locking tools having one or four slots are illustrated in the drawings, any suitable number of slots, locking pins or wedges may be used if desirable.

In FIG. 6, an embodiment of this invention is illustrated wherein one handle piece 35 has a vertically disposed slot 36, and the third piece 37 has an arc-like slot 38. Also the two handle pieces 35 and 34 have jaws 39 and 40 for holding and locking an item in place. It is critical to this invention that there be at least three pieces movably connected by an axle pin, that there be at least two arc-like slots such as slots 38 and 41, that these slots 38 and 41 spiral in different directions so that they form an X-like pattern (as shown at 14 in FIG. 3), that at least one piece (here it would be handle 35) have a vertically disposed slot, and that all slots be aligned so that the locking pin and axle pin can hold all pieces movably together. The locking pin must be deflectable or distortable so that it will cause a locking action against the faces of the diamond opening as shown in FIGS. 3, 4A and 4B. The embodiment of FIG. 6 is an alternative to preferred embodiment of FIG. 2.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A locking tool comprising in combination at least three pieces comprising a first handle piece, a second handle piece and a third piece, each of these three pieces movably connected to each other and having axle apertures in substantial alignment with each other, at least two of said three pieces having at least one arc-like slot, each positioned adjacent said axle aperture and at least one remaining piece having at least one vertically- disposed slot positioned adjacent its axle aperture, said arc-like slots spiralling in an opposite direction from at least one other arc-like slot in a different adjacent piece, a locking means movably disposed in each of said arc-like slots and said vertically-disposed slot, said locking means movably connecting said at least three pieces, and means to lock said first handle piece and said second handle piece in position.

2. The locking tool of claim 1 wherein said third piece and at least one handle piece have jaw pieces to form a gripping means.

3. The locking tool of claim 1 wherein said arc-like slots in adjacent pieces are arranged in relation to each other to form an X-like pattern when overlapped.

4. The locking tool of claim 1 having at least one arc-like slot in said first handle piece, at least one arc-like slot in said second handle piece and at least one vertically-disposed slot in said third piece.

5. The locking tool of claim 1 having at least two slots in said first handle piece, at least two slots in said second handle piece, and at least two slots in said third piece.

6. The locking tool of claim 1 wherein said vertically disposed slot is arranged to be substantially perpendicular to said arc-like slots when said locking tool is assembled.

7. The locking tool of claim 1 wherein said first and second handle pieces have jaw sections to form gripping surfaces.

8. The locking tool of claim 1 wherein said arc-like and vertically-disposed slots are positioned below said axle apertures in each of said first handle piece, said second handle piece and said third piece.

9. The locking tool of claim 1 wherein said arc-like and vertically-disposed slots have widths slightly larger than a diameter of said locking means.

10. The locking tool of claim 1 wherein said tool has a plurality of arc-like and vertically-disposed slots, a plurality of locking means in these slots, movable wedges attached to said locking means, and a gripping area between said movable wedges.

11. A locking tool comprising at least three movably-connected pieces, a first handle piece, a second handle piece and at least one jaw piece, said second handle piece having an axle aperture and at least one arc-like slot positioned at a point below said axle aperture, said first handle piece having an upper jaw portion and below said jaw portion an axle aperture, and below said axle aperture at least one arc-like slot, said arc-like slots in said first and second handle pieces spiralling in opposite directions when said first handle piece and said second handle piece are assembled in said locking tool, said jaw piece having a complementary jaw portion that cooperates with a second jaw portion in said first handle piece to form thereby a gripping means, said jaw piece having an axle aperture and below said axle aperture at least one vertically-disposed slot, an axle pin connecting the first handle piece, the second handle piece and the jaw piece through said axle apertures, and a locking pin positioned through each of said arc-like and vertically-disposed slots.

12. The locking tool of claim 1 wherein said arc-like slots in adjacent pieces are arranged in relation to each other to form an X-like pattern when overlapped.

13. The locking tool of claim 1 having at least one arc-like slot in said first handle piece, at least one arc-like slot in said second handle piece, and at least one vertically-disposed slot in said jaw piece.

14. The locking tool of claim 1 having at least two slots in said first handle piece, at least two slots in said second handle piece, and at least two slots in said jaw piece.

15. The locking tool of claim 1 wherein said vertically-disposed slot is arranged to be substantially perpendicular to said arc-like slots when said locking tool is assembled.

16. The locking tool of claim 1 wherein said arc-like and vertically-disposed slots have widths slightly larger than the diameter of said locking means.

17. A locking tool comprising in combination at least three pieces, a first handle piece, a second handle piece and a third piece or jaw piece, each of these three pieces having axle apertures in substantial alignment with each other, said first handle piece having at least one arc-like slot positioned adjacent said axle aperture, said second handle piece having at least one arc-like slot positioned adjacent said axle aperture and spiralling in an opposite direction from the arc-like slot in said first handle piece, said jaw piece having at least one vertically-disposed slot therein, a locking means disposed in said arc-like and vertically-disposed slots and having means to lock said first handle piece and said second handle piece and said jaw piece in position.

* * * * *